US006185406B1

(12) United States Patent
Ueda

(10) Patent No.: US 6,185,406 B1
(45) Date of Patent: Feb. 6, 2001

(54) IMAGE FORMING APPARATUS

(75) Inventor: Naofumi Ueda, Ikoma-gun (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/450,995

(22) Filed: Nov. 29, 1999

(30) Foreign Application Priority Data

Dec. 21, 1998 (JP) ..... 10-362163

(51) Int. Cl.[7] ..... G03G 15/00
(52) U.S. Cl. ..... 399/402; 399/364; 399/391
(58) Field of Search ..... 399/85, 82, 364, 399/391, 401, 402

(56) References Cited

U.S. PATENT DOCUMENTS 5,095,342 * 3/1992 Farrell et al. .
5,893,020 * 4/1999 Atsumi ..... 399/364

FOREIGN PATENT DOCUMENTS 5323720 12/1993 (JP) .

* cited by examiner

*Primary Examiner*—Richard Moses

(57) ABSTRACT

When the front and rear side (the first and second side) image data to be formed on both sides of the first paper and the front side data to be formed on one side (the first side) of the second paper are input in this sequence, the first paper is fed from a paper feed portion to an imaging portion, and is imaged on its first side with the image data and then is stored into the first intermediate tray. While the first paper is being stored into the first intermediate tray, the second sheet is fed from the paper feed portion to the imaging portion and formed on its first side with the image of the image data, and then is discharged to the paper output portion. While the second sheet is being discharged to the paper output portion, the first sheet is fed from the first intermediate tray to the imaging portion and formed on its second side with the image of the image data and then is discharged to the paper output portion.

10 Claims, 11 Drawing Sheets

IMAGE FORMING APPARATUS

BACKGROUND OF THE INVENTION (1) Field of the Invention

The present invention relates to an image forming apparatus in which images are formed selectively on one side or both sides of recording media based on the input image data.

(2) Description of the Related Art

A typical image forming apparatus for forming image on both sides of recording media has an intermediate tray which temporarily stores the recording media with an image on the first side thereon and is arranged in the recording media conveyance path extending from the paper feed potion to the paper output portion passing through the imaging portion. The recording media stored in the intermediate tray is inverted so as to be upside down and conveyed to the imaging portion so as to form an image on the second side. In such an image forming apparatus, recording media of which images are to be printed only on one side will be discharged to the paper output portion after passing through the imaging portion without being held in the intermediate tray.

In this way, the recording media of which images are to be printed on only one side is conveyed through the different path from that of the recording media of which images are to be printed on both sides. Therefore, in the image forming apparatus in which images can be formed selectively on one side or both sides of recording media based on the input image data, the conveyance path of the recording media needs to be switched selectively.

Accordingly, the conventional image forming apparatus is configured so that mode selection as to whether images are to be formed on one side or both sides of the recording media is designated before the start of image forming for a single medium or multiple recording media and then based on the selected mode a recording media conveyance path is selected. Therefore, in the conventional image forming apparatus, once an image forming operation is started, the recording media will be conveyed along the conveyance path designated based on the mode selected before the start of operation unless the operation is interrupted and the mode selection is changed.

Thus, in the conventional image forming apparatus, the designated mode at the start of operation, whichever it is, the duplex print mode or one-sided print mode, will be maintained during the image forming operation once it has been started. Therefore, if the image data to be supplied during an image forming operation started in the duplex print mode includes both the image data for forming images on both sides of the recording media and the image data for forming images on only one side of the recording media, the recording media of which images are to be formed only one side will also be conveyed along the same conveyance path as that of the recording media of which images are to be formed on both sides. Therefore, the recording media of which images are to be formed on only one side are compelled to be held in the intermediate tray and turned upside down, unnecessarily, causing a time loss and degradation of operational efficiency.

For example, referring to FIG. 1, in an image forming operation in the duplex print mode for image data of two sheets including image data $G_1$ and $G_2$ to be formed on both sides of the first recording medium $P_1$ and image data $G_3$ to be formed on one side of the second recording medium $P_2$, the first recording medium $P_1$ is fed from a paper feed portion 91 in a copier 90 and is formed on its first side with an image of image data $G_1$ via an imaging portion 92, and then is stored in an intermediate tray 93. Whilst this first recording medium $P_1$ is conveyed from intermediate tray 93 toward imaging portion 92 with its face upside down and is formed on its second side with an image of image data $G_2$, the second recording medium $P_2$ is fed from paper feed portion 91. After discharge of recording medium $P_1$ to a paper output tray 94, an image of image data $G_3$ is formed on the first side of recording medium $P_2$ via imaging portion 92. The recording medium $P_2$ of which the image of image data $G_3$ has been formed on the first side is also held in intermediate tray 93 and fed again to imaging portion 92. However, no image data to be formed is present in imaging portion 92, so that the recording medium $P_2$ is discharged to paper output tray 94 with no image formed on its second side. Thus the image forming operation is completed.

In this way, in conventional image forming apparatus 90, if the image data to be input during the image forming operation in the duplex printing mode includes image data $G_3$ for forming an image on only one side of a recording medium, recording medium $P_2$ on which the image of this image data $G_3$ is formed is forced, wastefully, to be conveyed to paper output tray 94 by way of intermediate tray 93 and imaging portion 92 despite the fact that no image is formed through the second passage of imaging portion 92.

As a technique to eliminate the time loss during an image forming operation in the duplex printing mode, Japanese Patent Application Laid-Open Hei No.5-323720 discloses a configuration wherein when a recording medium different in size from that held in the intermediate tray is conveyed to the intermediate tray, the image formation for the second side of the recording medium being held in the intermediate tray is performed in preference and then the position of the aligning means of the intermediate tray is controlled and switched. However this publication has no reference to eliminating the time loss arising when the image data input during the image forming operation started in the duplex printing mode includes both the image data for forming images on both sides of recording media and the image data for forming images on only one side of recording media.

SUMMARY OF THE INVENTION

It is therefore an object of the present invention to provide an image forming apparatus wherein selection of conveyance paths of each recording medium is performed based on the judgment of whether input image data is one for forming images on both sides of the recording medium or one for forming an image on one side thereof so as to positively eliminate the time loss arising when recording media of which images are to be formed on one side, are conveyed along the same path as recording media of which images are to be formed on both sides if the input image data includes both image data to be formed on both sides of the recording media and image data to be formed on only one side of the recording media, thus making it possible to improve the operational efficiency.

In order to achieve the above object, the present invention is configured as follows:

In accordance with the first aspect of the invention, an image forming apparatus includes: a determining process for determining whether the image data to be imaged is one for a recording medium of which images are formed on both sides or one for a recording medium of which an image is formed on only one side; and a conveyance path switching process for switching the conveyance path of the recording medium based on a determination result.

In accordance with the second aspect of the invention, the image forming apparatus having the above first aspect is characterized in that the conveyance path switching process switches the conveyance path between a first conveyance path for conveying a recording medium, on which an image has been formed on one side via a imaging portion, to a paper output portion by way of a storage portion and the imaging portion and a second conveyance path for directly conveying a recording medium, on which an image has been formed on one side via the imaging portion, to the paper output portion.

In accordance with the third aspect of the invention, the image forming apparatus having the above first or second aspect is characterized in that the conveyance path switching process further comprises a conveyance order determining process for determining the order of conveyance of the recording media passing through a plurality of conveyance paths, based on the determination result from the determining process and based on the conditions of conveyance including the conveyance time of the recording media.

In accordance with the fourth aspect of the invention, the image forming apparatus having the above third aspect is characterized in that the conveyance order determining process includes a process which determines the order in which recording media are conveyed from a paper feed portion or the storage portion to the imaging portion.

In accordance with the fifth aspect of the invention, the image forming apparatus having the above third aspect is characterized in that the conveyance order determining process determines the order in which recording media are discharged to the paper output portion.

In accordance with the sixth aspect of the invention, the image forming apparatus having the above fourth aspect is characterized in that the conveyance order determining process determines the order in which recording media are discharged to the paper output portion.

In accordance with the seventh aspect of the invention, the image forming apparatus having the above second, fourth, fifth or sixth aspect is characterized in that a plural number of storage portions are provided at appropriate positions along the conveyance path.

In accordance with the eighth aspect of the invention, the image forming apparatus having the above third aspect is characterized in that a plural number of storage portions are provided at appropriate positions along the conveyance path.

In accordance with the ninth aspect of the invention, the image forming apparatus having the above seventh or eighth aspect is characterized in that at least one of the storage portions is provided within the conveyance path connecting the downstream side of the imaging portion to the upstream side thereof while at least another, different storage portion is provided between the imaging portion and the paper output portion.

In the invention defined in the first aspect, based on the determination result as to whether each recording medium is one of which images are to be formed on both sides or one of which an image is to be formed on one side, the conveyance path of the recording medium is selected. Therefore, even in an image forming task which involves both recording media of which images are to be formed on both sides and recording media of which images are to be formed on one side, it is possible to correctly convey the recording media of which images are formed on both sides and the recording media of which images are formed on one side, in conformity with the image forming process to be performed upon them. As a result, no time loss occurs during the image forming task.

In the invention defined in the second aspect, based on the determination result as to whether each recording medium is one of which images are to be formed on both sides or one of which an image is to be formed on one side, the medium is selectively directed to the first conveyance path extending from the imaging portion to the paper output portion by way of the storage portion and imaging portion or the second conveyance path extending from the imaging portion to the paper output portion. Therefore, even in an image forming task which involves both recording media of which images are formed on both sides and recording media of which images are formed on one side, a recording medium, of which an image is formed on one side only, is avoided from being conveyed by way of the storage portion and imaging portion to the paper output portion after the image is formed on one side thereof. Thus, no time loss occurs during conveyance of recording media of which images are formed on one side.

In the invention defined in the third aspect, based on the determination result as to whether the recording media to be imaged are ones for duplex printing or ones for one-sided printing and based on the conditions of conveyance including conveyance time of the recording media, the order of conveyance of the recording media passing through a plurality of conveyance paths is determined. Therefore, in an image forming task which involves both recording media of which images are formed on both sides and recording media of which images are formed on one side, the order in which one recording medium to be imaged on both sides and another recording medium to be imaged on both sides are conveyed is determined, at least, by taking into account the time required for them to be conveyed. As a result, the image forming task can be carried out in the shortest period.

In the invention defined in the fourth aspect, based on the determination result as to whether the recording media to be imaged are ones for duplex printing or ones for one-sided printing and based on the conditions of conveyance including conveyance time of the recording media, it is determined which is started first, the conveyance of a recording medium from the paper feed portion to the imaging portion or the conveyance of another, different recording medium from the storage portion to the imaging portion. Therefore, in an image forming task which involves both recording media of which images are formed on both sides and recording media of which images are formed on one side, the order of the conveyance of one recording medium to be imaged on one side only from the paper feed portion and the conveyance of another, different recording medium to be image on both sides from the storage portion is determined, at least, by taking into account the time required for them to be conveyed. As a result, the image forming task can be carried out in the shortest period.

In the inventions defined in the fifth or sixth aspect, based on the determination result as to whether the recording media to be imaged are ones for duplex printing or ones for one-sided printing and based on the conditions of conveyance including conveyance time of the recording media, it is determined which is started first, either the conveyance of a recording medium from the imaging portion to the paper output portion or the conveyance of another, different recording medium from the storage portion to the paper output portion. Therefore, in an image forming task which involves both recording media of which images are formed on both sides and recording media of which images are formed on one side thereof, it is possible to determine which is discharged first from the imaging portion or the storage portion, the recording medium for duplex printing or the recording medium for one-sided printing, at least, by taking into account the time required for them to be conveyed. As a result, the image forming task can be carried out in the shortest period.

In the inventions defined in the seventh or eighth aspect, a plural number of storage portions are arranged in the conveyance path of recording media. Therefore, in an image forming task in which recording media to be imaged on both sides and recording media to be imaged on one side only are mixed arbitrarily, a plural number of recording media of which images are formed on one side or both sides can be stored as appropriate into any of the plural number of storage portions, thus obtaining a desired state of image formation.

In the invention defined in the ninth aspect, at least one storage portion is provided within the conveyance path connecting the downstream side of the imaging portion to the upstream side thereof while at least another storage portion is provided between the imaging portion and the paper output portion. That is, an extra storage portion is arranged between the imaging portion and the paper output portion, other than the storage portion for storing a recording medium which is to be imaged on both sides and has been already imaged on one side, so that the storage portion located between the image portion and the paper output portion can stores a recording medium having an image formed on one side or images on both sides before its discharge. Therefore, in an image forming task in which recording media to be imaged on both sides and recording media to be imaged on one side only are mixed arbitrarily, the recording media for duplex printing and one-sided printing can be discharged to the paper output portion in the desired order.

DESCRIPTION OF THE PREFERRED EMBODIMENTS

Figure 1:
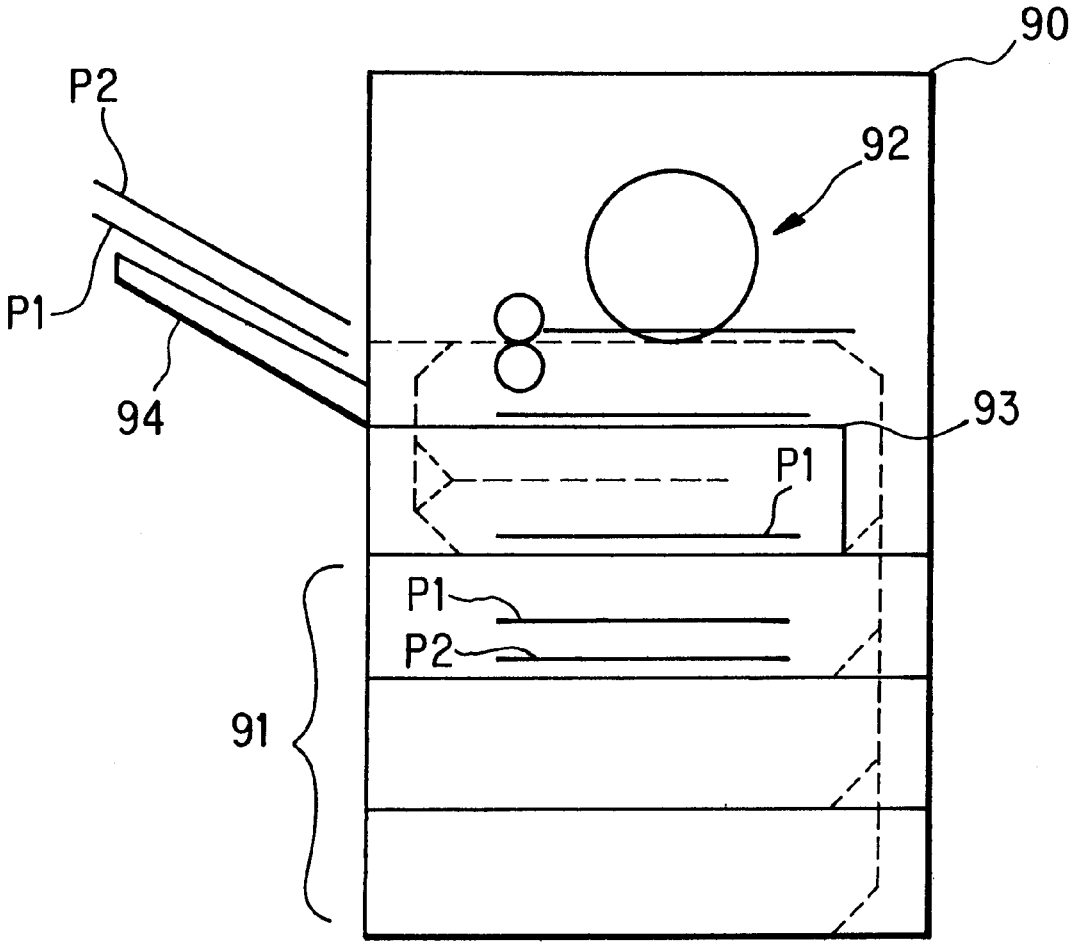
FIG. 1 PRIOR ART
FIG. 1 is a view showing an example of sheets being conveyed during image formation in a conventional image forming apparatus.
Figure 2:
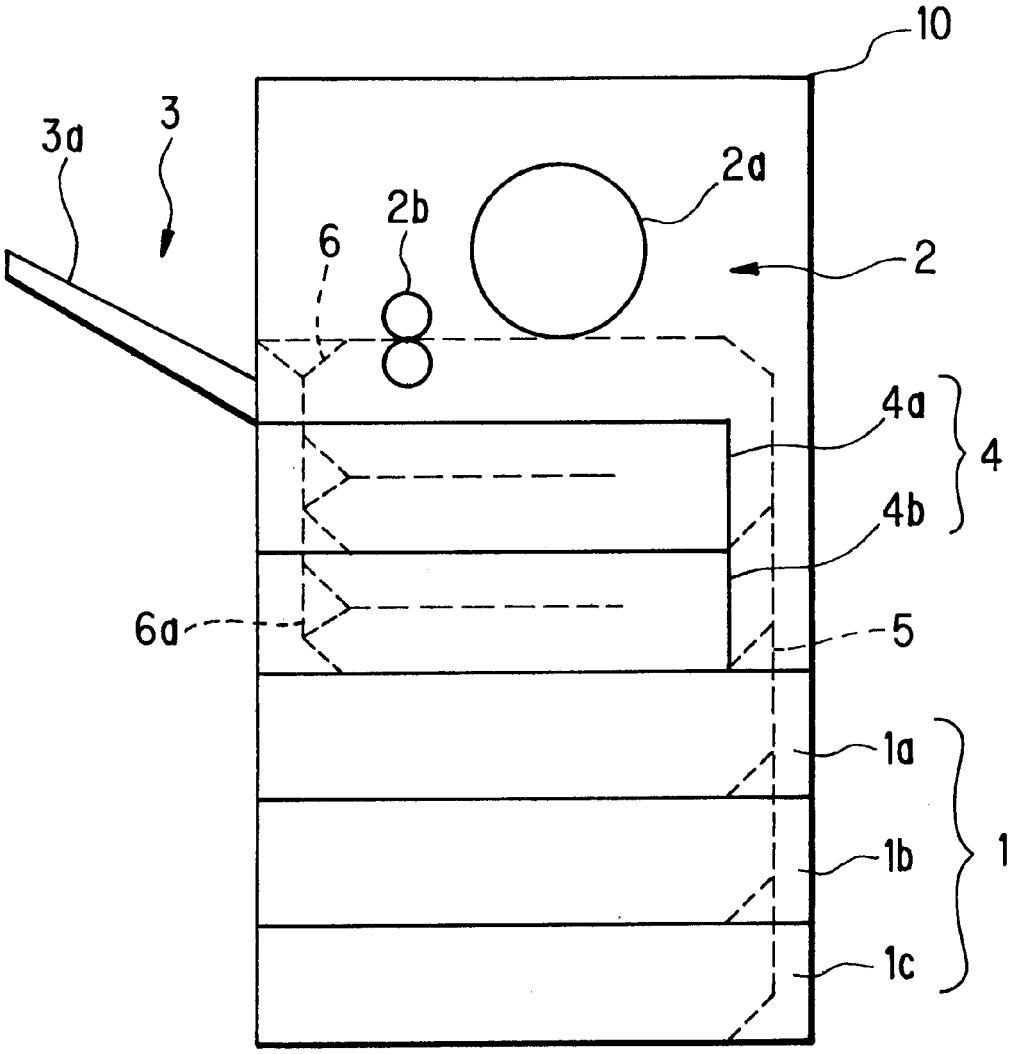
FIG. 2 is a view showing a schematic configuration of an image forming apparatus in accordance with the embodiment of invention.

FIG. 2 is a view showing a schematic configuration of an image forming apparatus in accordance with the embodiment of the invention. In an image forming apparatus 10, a paper feed portion 1, an imaging portion 2, a paper output portion 3 and a storage portion 4 are arranged so as to define a main conveyance path 5 formed from paper feed portion 1 to paper output portion 3 by way of imaging portion 2 and an auxiliary conveyance path 6 branched from main conveyance path 5 at a point between imaging portion 2 and paper output portion 3 and extended to the upstream side of imaging portion 2 by way of storage portion 4. In paper feed portion 1, paper cassettes 1*a* to 1*c* each accommodating sheet-like recording media (to be referred to as paper despite the fact that sheet-like recording media include materials other than paper such as OHP films etc.) of a unique size are mounted. Paper is fed sheet by sheet from any one of paper cassettes 1*a* to 1*c* by the rotation of unillustrated feed rollers arranged correspondingly to paper cassettes 1*a* to 1*c*.

Imaging portion 2 includes image forming devices such as a photosensitive drum 2*a*, a fixing roller 2*b* and the like and forms images on the surface of the paper by the electrophotographic technique. More specifically, the surface of photosensitive drum 2*a* rotating at a constant rate during image formation is supplied with static charge of an unique polarity from an unillustrated charger, and then the drum surface is illuminated with light of an image which is modulated based on the image data and emitted from an unillustrated writing unit so as to produce a static latent image by virtue of the photoconductive effect. At the same time, a developer is supplied from an unillustrated developing device. The static latent image is visualized by electrostatic attraction of the thus supplied developer and developed into a developer image. The surface of photosensitive drum 2*a* bearing this developer image is arranged so as to oppose an unillustrated transfer device with the paper in between. This transfer device causes a corona discharge over the paper so that the developer image is transferred from the surface of photosensitive drum 2*a* to the paper surface. The paper with a developer image transferred on its surface is heated and pressurized by fixing rollers 2*b* so as to fuse the developer image and fix it on the paper surface.

Paper output portion 3 is configured of a paper output tray 3*a* attached to one side face of image forming apparatus 10 and unillustrated discharge rollers arranged along main conveyance path 5. Storage portion 4 has two layered intermediate trays 4*a* and 4*b*. The paper having passed through imaging portion 2 and having an image on its one side is stored, directly or after it has been turned upside down, in the intermediate trays 4*a* and 4*b*. For this purpose, a switchback conveyance path 6*a* for inverting the paper so as to be upside down by switching the rear edge of the paper forward is provided on the upstream side of storage portion 4 in auxiliary conveyance path 6. The paper having passed through imaging portion 2 and hence having an image on its one side is selectively directed to intermediate tray 4*a* or 4*b* by way of switchback conveyance path 6*a*. Further, intermediate trays 4*a* and 4*b* are configured so that the paper can be directly discharged from these trays to paper output tray 3*a* of paper output portion 3, without being routed through imaging portion 2.

Figure 3:
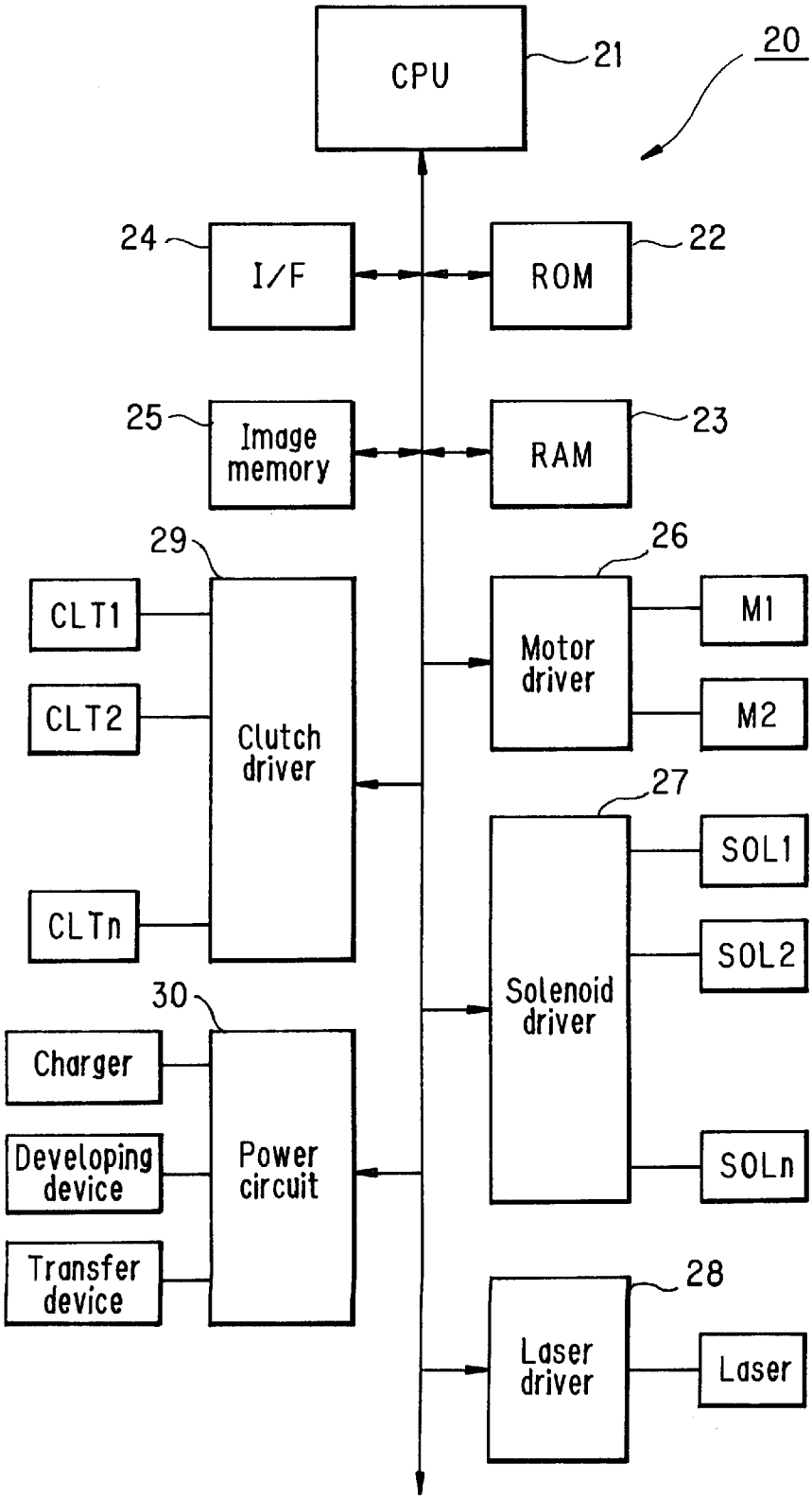
FIG. 3 is a block diagram showing a configuration of a controller of the image forming apparatus.

FIG. 3 is a block diagram showing a configuration of a controller of the image forming apparatus. The description will be made also referring to FIG. 2. A controller 20 of image forming apparatus 10 includes a CPU 21 with a ROM 22 and RAM 23 and connected to input/output devices such as an interface 24, an image memory 25, a motor driver 26, a solenoid driver 27, a laser driver 28, a clutch driver 29 and a power circuit 30, etc. CPU 21 outputs drive data at predetermined timings to associated input/output devices, in conformity with the program previously written in ROM 22 so as to execute image formation. The data input to or output from CPU 21 during the image formation is stored in the predetermined memory area in RAM 23.

Interface 24 is connected to external image output devices such a personal computer, scanner and the like and receives image data from these image output devices. Image memory 25 stores the image data input through interface 24. Motor driver 26 drives a main motor M1 and mirror M2, in accordance with the drive data output from CPU 21. Main motor M1 provides rotational driving forces for photosensitive drum 2*a*, fixing roller 2*b*, unillustrated conveying means arranged along main conveyance path 5 and auxiliary conveyance path 6. Mirror motor M2 rotates the polygon mirror in the writing unit provided in imaging portion 2.

Solenoid driver 27 drives solenoids SOL 1, 2 . . . n, based on the drive data output from CPU 21. Solenoids SOL 1, 2, . . . n move flappers arranged at appropriate positions in main conveyance path 5 and auxiliary conveyance path 6. Laser driver 28 drives the semiconductor laser in the writing unit provided in imaging portion 2 in accordance with the image data supplied from CPU 21 so as to emit light of an image modulated by the image data. Clutch driver 29, based on the drive data from CPU 21, drives clutches CLT 1, 2, . . . n. Clutches CLT 1, 2, . . . n connect or disconnect the rotation of main motor M1 with respect to the paper feed rollers located in paper feed portion 1, paper conveyance rollers located in storage portion 4, and the like. Power circuit 30 applies voltages to an unillustrated charger, developing device and transfer device arranged in imaging portion 2, in accordance with the drive data output from CPU 21. Accordingly, these solenoids and clutches driven by solenoid driver 27 and clutch driver 29 are selectively switched to change the paper conveyance path.

The image data is sequentially supplied pagewise via interface 24. Each page of image data supplied via interface 24 is attached with a data identifier for indicating that the page of image data is one for a sheet of which images are printed on both sides (image data for duplex printing) or that the page of image data is one for a sheet of which an image is printed only on one side (image data for one-sided printing). CPU 21, based on this data identifier attached to each page of image data, determines that the input page of image data is either of image data for duplex printing or image data for one-sided printing and controls switching of the associated solenoids and clutches in accordance with the drive data supplied to solenoid driver 27 and clutch driver 29 based on the determination result. CPU 21 stores the determination result as to the image data stored in image memory 25, into a predetermined memory area in RAM 23.

Figure 4:
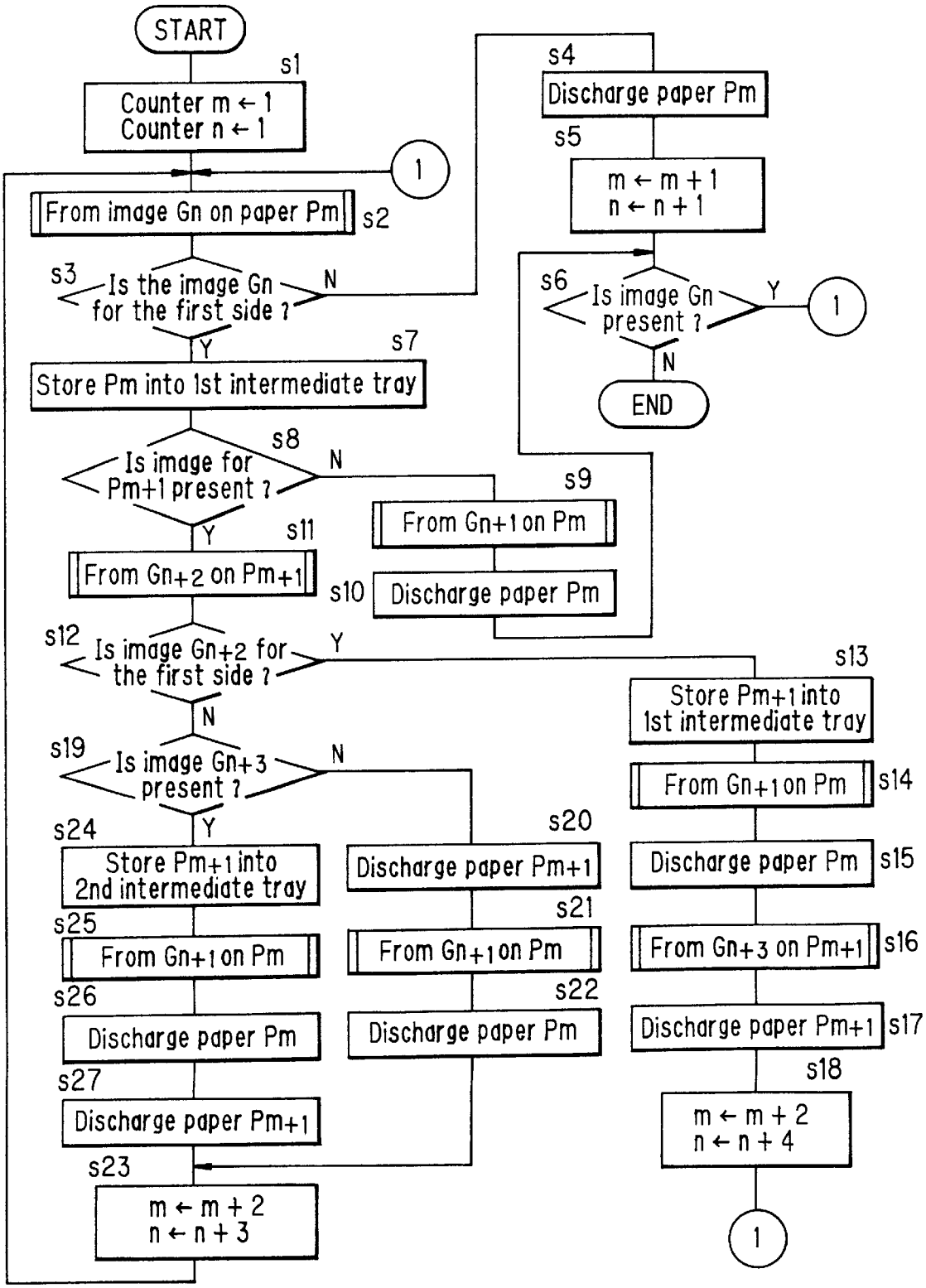
FIG. 4 is a flowchart showing part of procedural steps of the controller of the image forming apparatus.

FIG. 4 is a flowchart showing part of the procedural steps of the controller of the image forming apparatus. The flow of operation will be described also with reference to FIGS. 2 and 3. CPU 21 constituting controller 20 of image forming apparatus 10 first sets counters m and n at '1' at the start of image formation (s1). Here, counter m counts the paper number while counter n counts the number of pages of image data. These count values are allotted to predetermined memory area in RAM 23. Next, CPU 21 controls so as to form an image of image data $G_n$ of the n-th page on the m-th paper $P_m$ (s2), and judges whether image data $G_n$ is one for duplex printing (s3). When image data $G_n$ is one for one-sided printing, CPU 21 controls so as to discharge paper $P_m$ to paper output tray 3*a* (s4), then the count values on counters m and n are incremented (s5). When a next page of image data is present, the operation returns to s2 (s6).

At s3, when image data $G_n$ is one for duplex printing, CPU 21 directs paper $P_n$ to first intermediate tray 4*a* by way of switchback conveyance path 6*a* (s7) and makes a judgment as to whether image data $G_{n+2}$ to be formed on next paper $P_{m+1}$ is present (s8). When no image data $G_{n+2}$ to be formed on the next paper $P_{m+1}$ is present, CPU 21 controls so as to form the image of image data $G_{n+1}$ on the second side of paper $P_m$ having been stored in first intermediate tray 4*a* (s9) and discharge paper $P_m$ to paper output tray 3*a* (s10).

At s8, when image data $G_{n+2}$ to be formed on the next paper $P_{m+1}$ is present, CPU 21 controls so as to feed a next sheet of paper $P_{m+1}$ from paper feed portion 1 while paper $P_m$ is being stored in first intermediate tray 4*a* and then to form the image of image data $G_{n+2}$ on this paper $P_{m+1}$ (s11) and makes a judgement as to whether image data $G_{n+2}$ is one for duplex printing (s12). When image data $G_{n+2}$ is one for duplex printing, CPU 21 controls so as to convey paper $P_{m+1}$ into first intermediate tray 4*a* by way of switchback conveyance path 6*a* (s13) and form the image of image data $G_{n+1}$ on the second side of paper $P_m$ having been stored in first intermediate tray 4*a* and discharge paper $P_m$ to paper output tray 3*a* (s14 and s15). Then, the CPU controls so as to form the image of image data $G_{n+3}$ on the second side of paper $P_{m+1}$ having been stored in first intermediate tray 4*a* and discharge it to paper output tray 3*a* (s16 and s17). Thereafter, CPU 21 increases the count value on counter m by 2 and the count value on counter n by 4 and then the operation returns to s2 (s18).

At s12, when image data $G_{n+2}$ is not one for duplex printing, CPU 21 makes a judgement as to whether the next image data $G_{n+3}$ is present (s19). When no image data $G_{n+3}$ to be formed next is present, CPU 21 controls so as to discharge paper $P_{m+1}$ having the image of one-sided image data $G_{n+2}$ formed thereon to paper output tray 3*a* (s20) and form the image of image data $G_{n+1}$ on the second side of paper $P_m$ having been stored in first intermediate tray 4*a* and then to discharge paper $P_m$ to paper output tray 3*a* (s21 and s22). At the same time, the CPU increases the count values of counters m and n by 2 and 3, respectively and then the operation returns to s2 (s23).

At s19, when image data $G_{n+3}$ to be formed next is present, CPU 21 controls so as to store paper $P_{m+1}$ having the image of one-sided image data $G_{n+2}$ formed thereon into second intermediate tray 4*b* without passing through switchback conveyance path 6*a* (s24) and form the image of image data $G_{n+1}$ on the second side of paper $P_m$ having been stored in first intermediate tray 4*a* and then discharge paper $P_m$ to paper output tray 3*a* (s25 and s26). Thereafter, the CPU performs control so as to convey paper $P_{m+1}$ stored in second intermediate tray 4*b* in the reverse direction in auxiliary conveyance path 6 without passing through imaging portion 2 and directly discharge it to paper output tray 3*a* (s27). The CPU then increases the count values of counters m and n by 2 and 3, respectively and then the operation returns to s2 (s23).

In the above way, in image forming apparatus 10 according to this embodiment, the paper conveyance path is selectively switched depending upon whether the image data for forming images on paper is one for duplex printing or one for one-sided printing. As a result, even if data including both image data for duplex printing and image data for one-sided printing is input, it is possible to perform image forming of the image data for duplex printing and that for image data for one-sided printing, in the appropriate way.

Figure 5A:
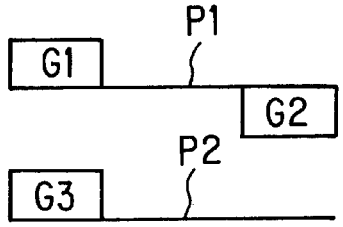
FIG. 5A shows an example of image data including both duplex printing image data and one-sided printing image data and FIG. 5B shows an example of sheets being conveyed during image formation when the image data shown in FIG. 5A is input.
Figure 5B:
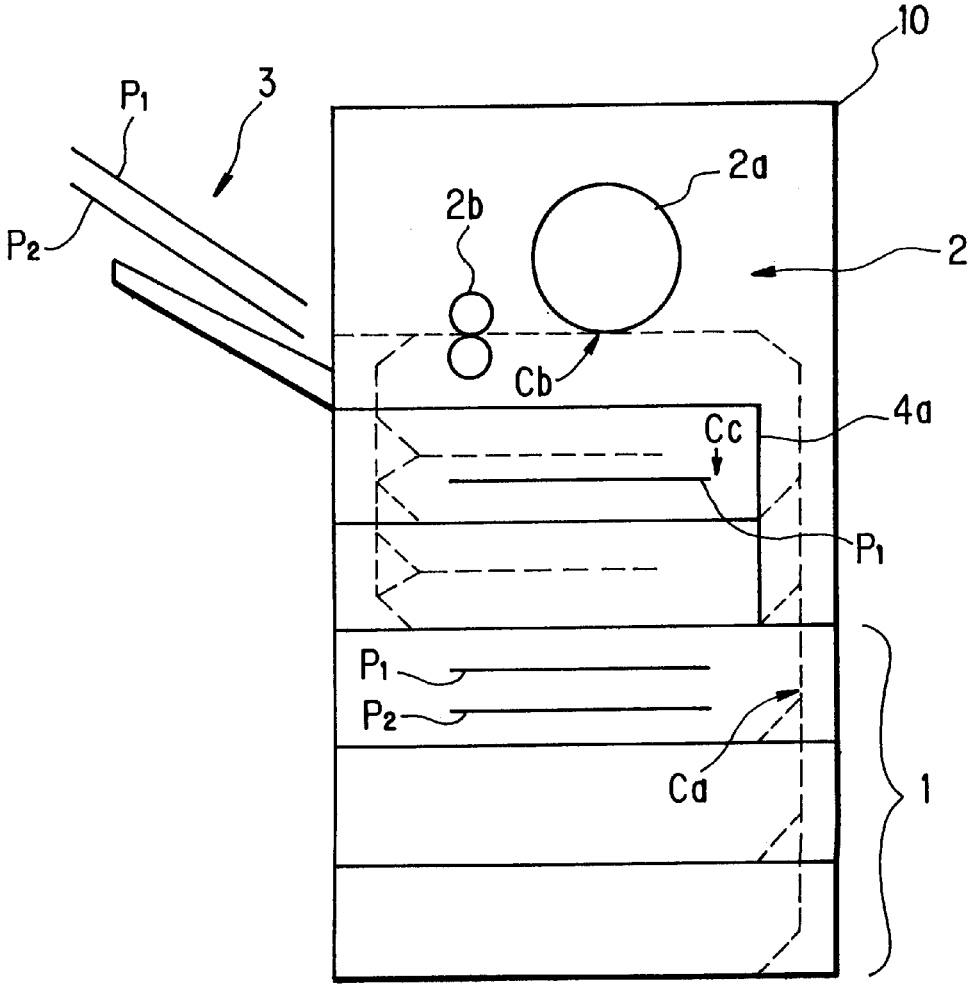

For example, as shown in FIG. 5A, when image data $G_1$ and $G_2$ to be formed on both sides of the first paper $P_1$ and also image data $G_3$ to be formed on one side of the second paper $P_2$ are input in this sequential order, the first paper $P_1$ is fed from paper feed portion 1 in image forming apparatus 10 to imaging portion 2 as shown in FIG. 5B so that the image of image data $G_1$ is formed on the first side of paper $P_1$. Thereafter, paper $P_1$ is inverted upside down and stored into first intermediate tray 4*a*. While paper $P_1$ is being stored in first intermediate tray 4*a*, the second paper $P_2$ is fed from paper feed portion 1 to imaging portion 2. After the image of image data $G_3$ is formed on the first side of paper $P_2$, paper $P_2$ is discharged to paper output portion 3. While paper $P_2$ is being discharged to paper output portion 3, paper $P_1$ is fed from first intermediate tray 4*a* to imaging portion 2 so as to form the image of image data $G_2$ on the second side of paper $P_1$, then paper $P_1$ is discharged to paper output portion 3.

In this way, while the first paper $P_1$ having the image of image data $G_1$ formed on its first side is conveyed from a position Cb in imaging portion 2 to a position Cc in first intermediate tray 4*a*, the second paper $P_2$ is conveyed from a position Ca in paper feed portion 1 to position Cb in imaging portion 2. Therefore, the time for conveying two papers $P_1$ and $P_2$ can be reduced, thus making it possible to improve the operational efficiency.

Figure 6A:
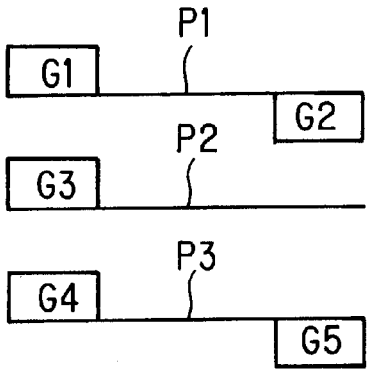
FIG. 6A shows another example of image data including duplex printing image data and one-sided printing image data and FIG. 6B shows an example of sheets being conveyed during image formation when the image data shown in FIG. 6A is input.
Figure 6B:
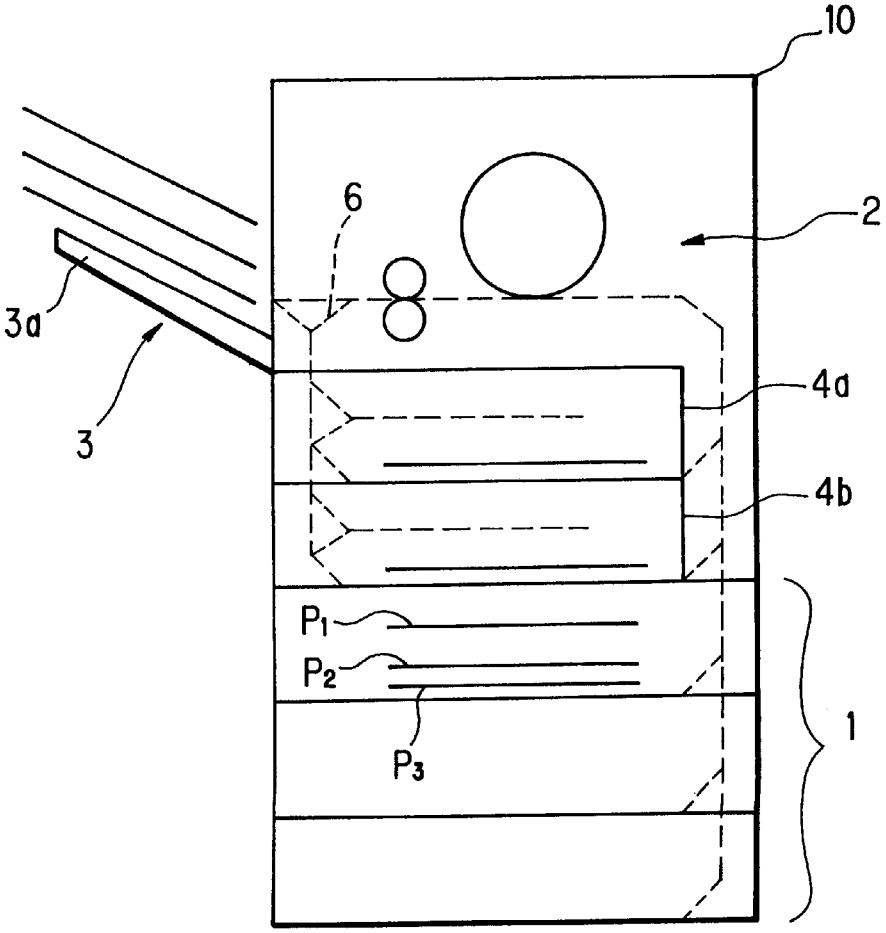

As another case shown in FIG. 6A, when image data $G_1$ and $G_2$ to be formed on both sides of the first paper $P_1$, image data $G_3$ to be formed on one side of the second paper $P_2$, and image data $G_4$ and $G_5$ to be formed on both sides of the third paper $P_3$ are input in this sequential order, the first paper $P_1$ is fed from paper feed portion 1 to imaging portion 2 in image forming apparatus 10 so as to form the image of image data $G_1$ on the first side of paper $P_1$, as shown in FIG. 6B. Then, paper $P_1$ is inverted upside down and stored into first intermediate tray 4*a*. While paper $P_1$ is stored into first intermediate tray 4*a*, the second paper $P_2$ is fed from paper feed portion 1 to imaging portion 2 so that the image of image data $G_3$ is formed on the first side of this paper $P_2$. The steps up to this point are the same as the example shown in FIGS. 5A and 5B.

Paper $P_2$ having the image of image data $G_3$ formed thereon is stored into second intermediate tray 4*b* without being inverted upside down. During this, the first paper $P_1$ is fed from the first intermediate tray to imaging portion 2, and the image of image data $G_2$ is formed on the second side of paper $P_1$ so that paper $P_1$ having images on both sides thereof is discharged to paper output portion 3. Thereafter, paper $P_2$ is directly discharged to paper output tray 3*a* by being conveyed in the reverse direction from second intermediate tray 4*b* along auxiliary conveyance path 6, without passing through imaging portion 2. During discharging of paper $P_2$ from second intermediate tray 4*b* to paper output portion 3, the third paper $P_3$ is fed from paper feed portion 1 to imaging portion 2 so that the image of image data $G_4$ is formed on the first side of paper $P_3$. After the image of image data $G_4$ has been formed on the first side of paper $P_3$, paper $P_3$ is inverted upside down and conveyed by way of first intermediate tray 4*a* and directly fed to imaging portion 2 where the image of image data $G_5$ is formed on the second side. Then this paper is discharged to paper output portion 3.

In this way, when paper $P_2$ which is located between two sheets of paper $P_1$ and $P_3$ of which images are formed on both sides thereof is one of which an image is formed on only one side, the second paper $P_2$ with an image on its one side is stored in second intermediate tray 4*b*, while the first paper $P_1$ stored in first intermediate tray 4*a* is discharged to paper output portion 3, ahead of paper $P_2$. Thus, it is possible to stack three sheets of paper $P_1$ to $P_3$ in the collated order in paper output portion 3. Here, the number of intermediate trays provided in storage portion 4 should not be limited to two.

Figure 7:
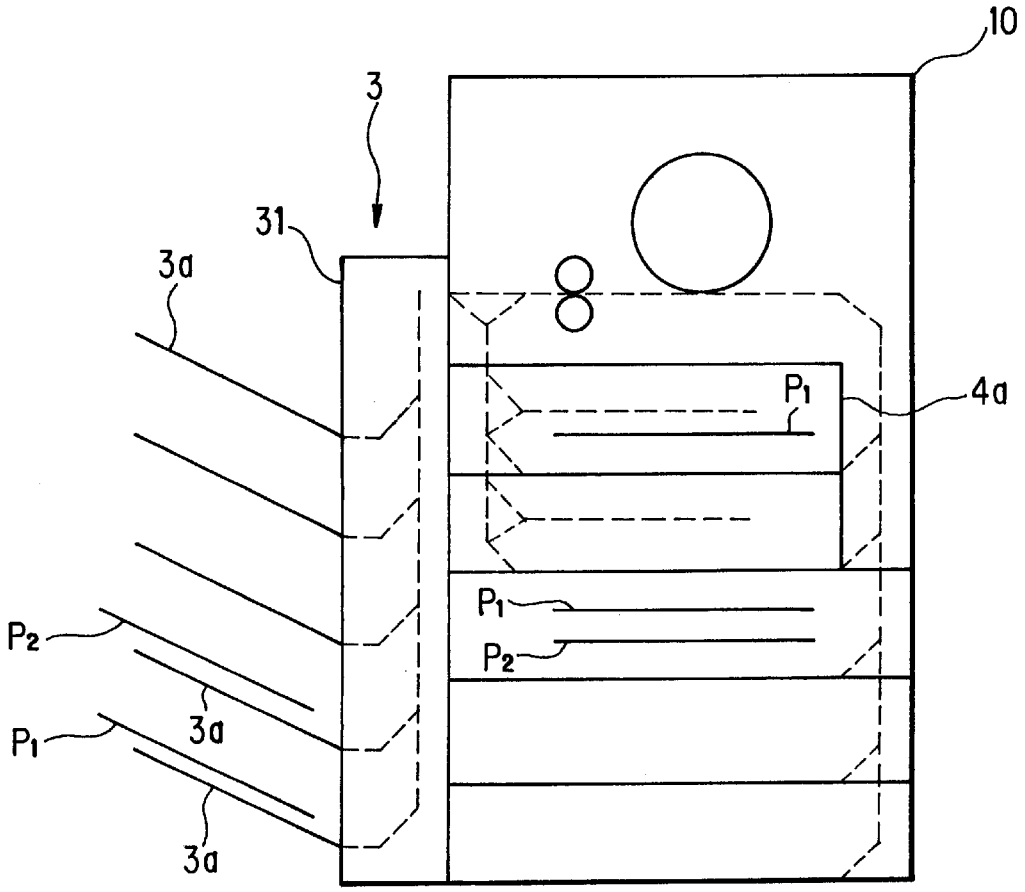
FIG. 7 is a view showing an example of sheets conveyed during image formation in an image forming apparatus having another configuration of the invention.

In a configuration where a sorter 31 having a plurality of paper output trays 3*a* is attached to paper output portion 3 of image forming apparatus 10 as shown in FIG. 7, the first paper $P_1$, the second paper $P_2$, the third paper $P_3$ . . . may be discharged one by one to, for example, the lowermost discharge tray 3*a*, the second from the bottom, the third from the bottom, and so on. In this case, CPU 21 of image forming apparatus 10, based on the data identifier attached to each piece of the input image data, recognizes where, by its ordinal number, is the sheet formed with the image of a specific piece of image data, and discharges each paper to an appropriate paper output tray 3*a* by controlling the conveyance mechanism of sorter 31. By this configuration, it is possible to discharge the imaged sheets of paper in a desired order in paper output portion 3 without using a plurality of intermediate trays in storage portion 4, even when image data having both image data for duplex printing and image data for one-sided printing arbitrarily mixed therein is input.

Figure 8:
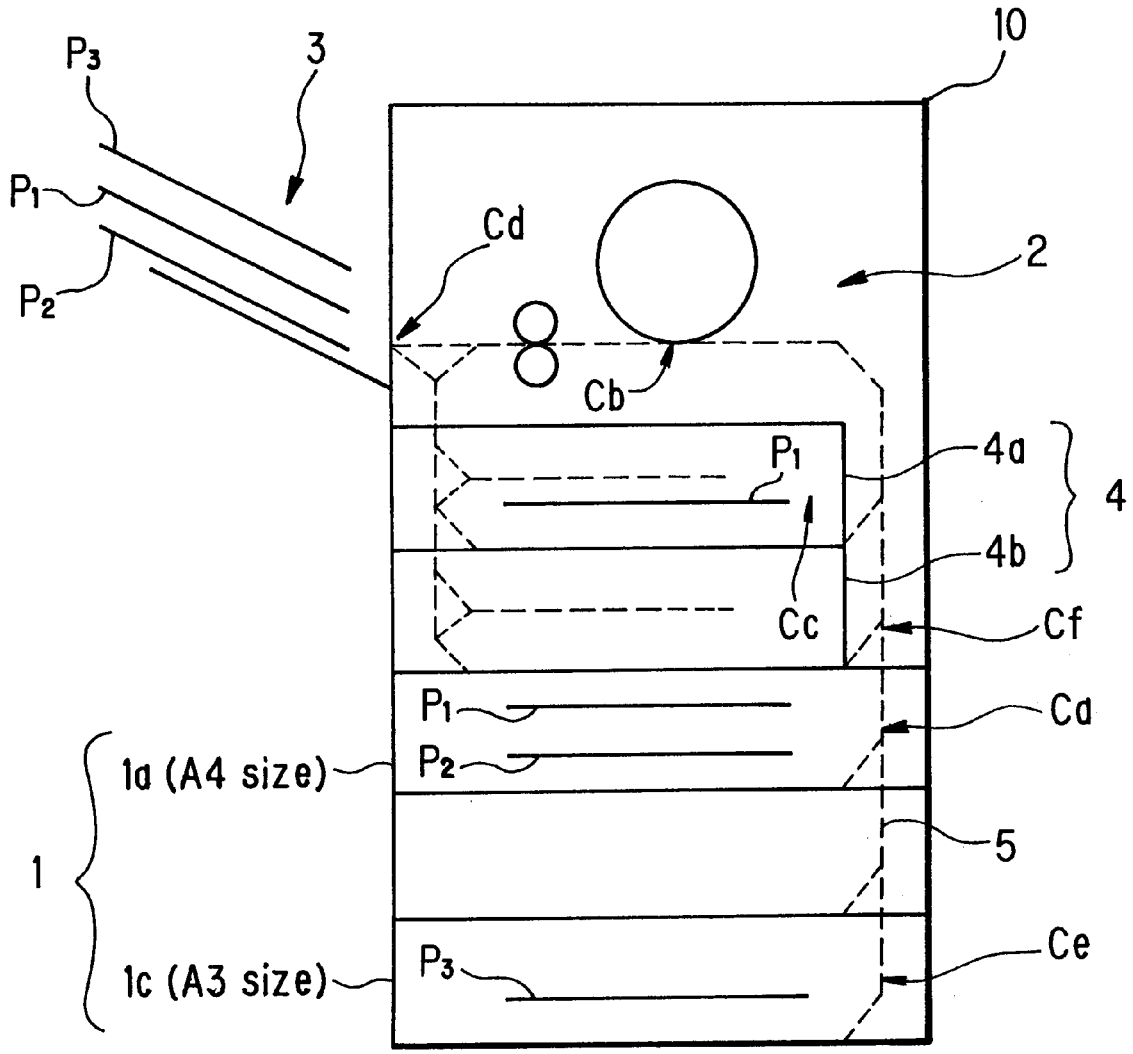
FIG. 8 shows an example of sheets of different sizes conveyed during image formation when image data including both duplex printing image data and one-sided printing image data is input to the image forming apparatus.

FIG. 8 shows an example of sheets of different sizes conveyed during image formation when image data including both image data for duplex printing and image data for one-sided printing is input to the image forming apparatus. In this example, it is assumed that duplex print image data $G_1$ to be formed on the first side of the first paper $P_1$, duplex print image data $G_2$ to be formed on the second side of the first paper $P_1$, one-sided print image data $G_3$ to be formed on the second paper $P_2$, and one-sided print image data $G_4$ to be formed on the third paper $P_3$, are input. It is also assumed that the first and second papers $P_1$ and $P_2$ are of A4 size while the third paper $P_3$ is of A3 size, and A4-sized paper is stored in the first paper cassette 1*a* and A3-sized paper is stored in the third paper cassette 1*c* in paper feed portion 1 of image forming apparatus 10.

As above where different papers stored in different positions in paper feed portion 1 are fed, the time required for all the sheets to be imaged varies depending upon the order in which the sheets are fed because the conveyance path length of each sheet is different from that of the others. Therefore, in order to optimize the operational efficiency of image forming apparatus 10, it is necessary to determine the sequential order for image forming of a plurality of pieces of image data by taking into account the conveyance time of each sheet.

Here, in the above example, paper $P_1$ of A4 size is fed first from first paper cassette 1*a* so as to form the image of image data $G_1$ on the first side of paper $P_1$ via imaging portion 2. This paper $P_1$ is then stored into first intermediate tray 4*a*. Next, paper $P_2$ of A4 size is fed from first paper cassette 1*a* so as to form the image of image data $G_3$ via imaging portion 2. This paper $P_2$ is discharged to paper output portion 3.

Thereafter, a comparison is made between the time required for paper $P_1$ to be conveyed from position Cc in intermediate tray 4*a* to position Cb in imaging portion 2 and the time required for paper $P_3$ to be conveyed from position Ce in paper cassette 1*c* to the middle position Cf of main conveyance path 5 so as to determine which to perform first, either imaging of the image data $G_2$ on paper $P_1$ or the imaging of image data $G_4$ on paper $P_3$. Here, since the time for paper $P_1$ to be conveyed from position Cc to position Cb is shorter than the time for paper $P_3$ to be conveyed from position Ce to position Cf, paper $P_1$ is imaged first with image data $G_2$ and is discharged to paper output portion 3. Thereafter, paper $P_3$ is imaged with image data $G_4$ and is discharged to paper output portion 3.

By this flow of operation, the feed of paper $P_1$ from intermediate tray 4*a* can be performed approximately in parallel with the feed of paper $P_3$ from paper cassette 1*c*, so as to complete the image forming process of input image data $G_1$ to $G_4$, optimizing the operational efficiency of image forming apparatus 10.

It should be noted that the time for each sheet to be conveyed may be computed taking into account not only the conveyance distance of the paper but also other conveyance conditions such as the time required for picking up and feeding each sheet from its accommodated position, conveyance speed and the like.

Figure 9:
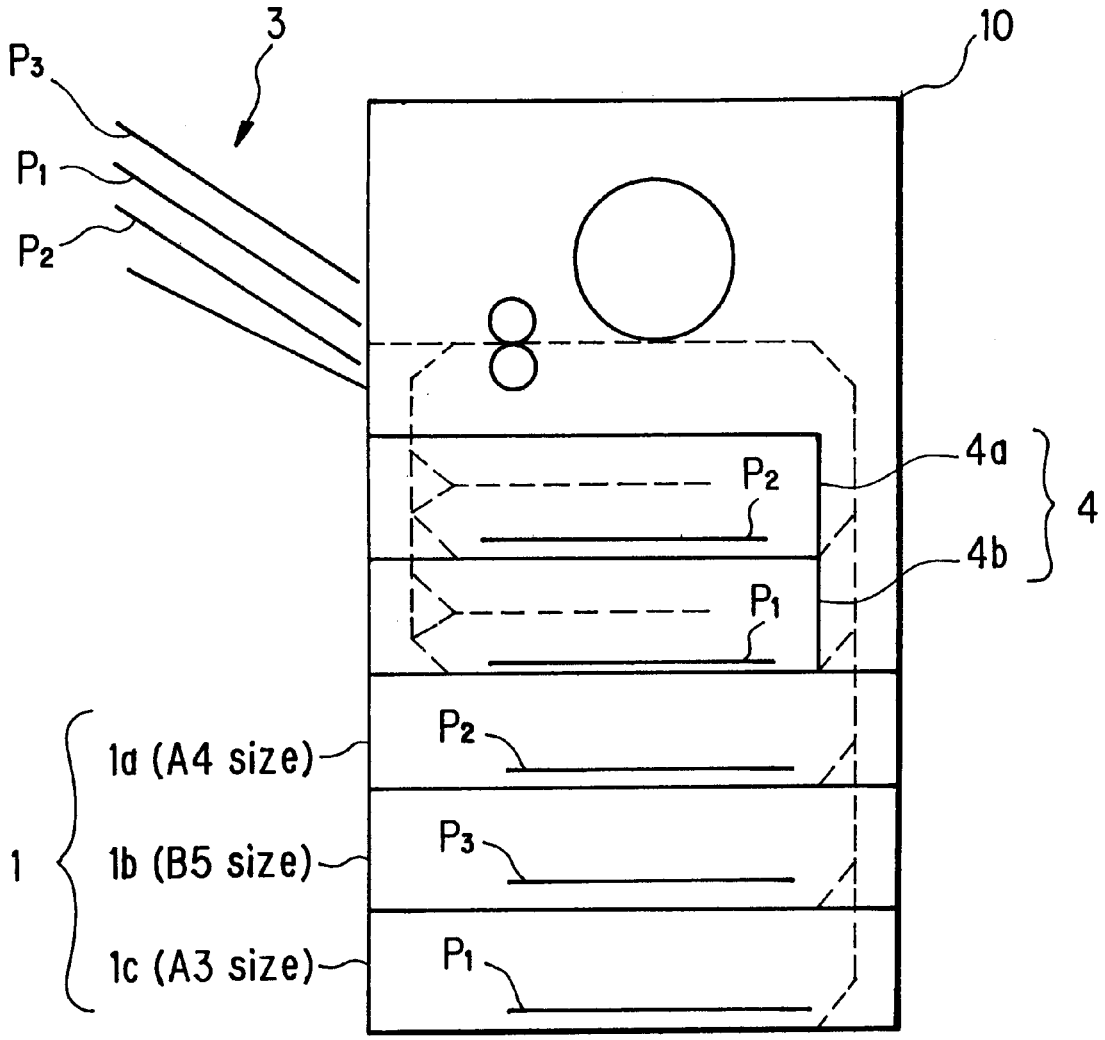
FIG. 9 shows another example of sheets of different sizes conveyed during image formation when image data including both duplex printing image data and one-sided printing image data is input to the image forming apparatus.

FIG. 9 shows another example of sheets of different sizes conveyed during image formation when image data including both image data for duplex printing and image data for one-sided printing is input to the image forming apparatus. In this example, it is assumed that duplex print image data $G_1$ to be formed on the first side of the first paper $P_1$, duplex print image data $G_2$ to be formed on the second side of the first paper $P_1$, duplex print image data $G_3$ to be formed on the first side of the second paper $P_2$, duplex print image data $G_4$ to be formed on the second side of the second paper $P_2$, and one-sided print image data $G_5$ to be formed on the third paper $P_3$, are input. It is also assumed that the first paper $P_1$ is of A3 size, the second paper $P_2$ is of A4 size and the third paper $P_3$ is of B5 size, and A4-sized paper is stored in the first paper cassette 1*a*, B5-sized paper is stored in the second paper cassette 1*b* and A3-sized paper is stored in the third paper cassette 1*c* in paper feed portion 1 of image forming apparatus 10.

In this case, paper $P_2$, which can be conveyed to imaging portion 2 in the shortest time is fed first from paper cassette 1*a* so that the image of image data $G_3$ is formed on the first side of paper $P_2$. Then, this paper $P_2$ is stored into second intermediate tray 4*b*. While image forming of paper $P_2$ is performed, paper $P_1$ is fed from paper cassette 1*c*, and while paper $P_2$ is stored into second intermediate tray 4*b*, the image of image data $G_1$ is formed on the first side of paper $P_1$. Thereafter, paper $P_1$ is stored into first intermediate tray 4*a*.

Then, the time required for paper $P_3$ to be conveyed from paper cassette 1*c* to the middle position of main conveyance path 5 is compared with the time required for paper $P_1$ to be conveyed from first intermediate tray 4*a* to imaging portion 2 and with the time required for paper $P_2$ to be conveyed from second intermediate tray 4*b* to imaging portion 2. Based on this comparison result, paper $P_1$ is fed first from first intermediate tray 4*a*, imaged on its second side with image data $G_2$ and then discharged to paper output portion 3. Next, paper $P_2$ is fed from second intermediate tray 4*b*, imaged on its second side with image data $G_4$ and then discharged to paper output portion 3. Finally, paper $P_3$ is imaged with image data $G_5$ and discharged to paper output portion 3.

By this flow of operation, use of a plurality of intermediate trays 4*a* and 4*b* makes it possible to start the feeding of paper $P_2$ from second intermediate tray 4*b* and the feeding of paper $P_3$ from paper cassette 1*b*, approximately simultaneously. Consequently, it is possible to complete the image forming process of input image data $G_1$ to $G_5$, optimizing the operational efficiency of image forming apparatus 10.

Figure 10:
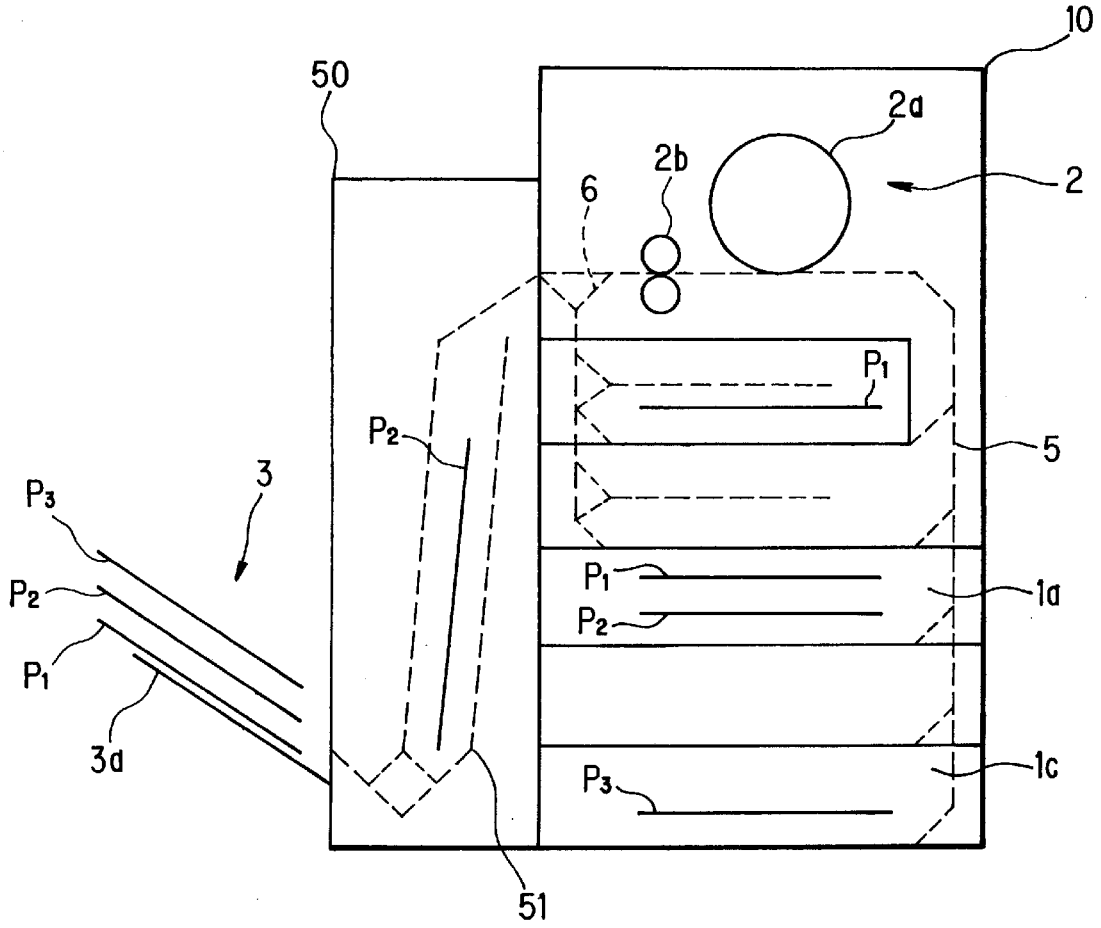
FIG. 10 is a view showing a schematic configuration of an image forming apparatus in accordance with another embodiment of invention.

FIG. 10 is a view showing a schematic configuration of an image forming apparatus in accordance with another embodiment of the invention. In image forming apparatus 10 of this embodiment, a post-processing apparatus 50 is mounted on the side face of the main body on the paper output portion 3 side. Post-processing apparatus 50 incorporates a third intermediate tray 51 which is arranged on the upstream side of paper output tray 3*a* along the paper conveyance path. Therefore, third intermediate tray 51 is arranged between imaging portion 2 and paper discharge tray 3*a*.

In image forming apparatus 10 having the above configuration, it is assumed as an example that duplex print image data $G_1$ to be formed on the first side of the first paper $P_1$, duplex print image data $G_2$ to be formed on the second side of the first paper $P_1$, one-sided print image data $G_3$ to be formed on the second paper $P_2$ and one-sided print image data $G_4$ to be formed on the third paper $P_3$, are input. It is also assumed that the first and second sheets of paper $P_1$ and $P_2$ are of A4 size and the third paper $P_3$ is of A3 size, and A4-sized paper is stored in the first paper cassette 1*a* and A3-sized paper is stored in the third paper cassette 1*c* in paper feed portion 1 of image forming apparatus 10.

In this case, paper $P_1$ of A4 size is fed first from first paper cassette 1*a* so as to form the image of image data $G_1$ on the first side of paper $P_1$ via imaging portion 2. This paper $P_1$ is then stored into first intermediate tray 4*a*. Next, paper $P_2$ of A4 size is fed from first paper cassette 1*a* so as to form the image of image data $G_3$ via imaging portion 2. This paper $P_2$ is then stored into third intermediate tray 51. Thereafter, paper $P_1$ is imaged with image data $G_2$ and discharged to paper output tray 3*a*, then the paper $P_2$ stored within third intermediate tray 51 is discharged to paper output tray 3*a*. Subsequently, paper $P_3$ is imaged with image data $G_4$ and discharged to paper output portion 3.

By this configuration, during the period after paper $P_1$ is fed from first intermediate tray 4*a* until paper $P_2$ is discharged from third intermediate tray 51, paper $P_3$ can be fed from paper cassette 1*c*. Hence, it is possible to complete the image forming process of input image data $G_1$ to $G_4$, optimizing the operational efficiency of image forming apparatus 10 while the three sheets of paper can be stacked in a collated order on paper output tray 3*a*, facilitating easy handling of plural number of sheets after image formation.

Figure 11:
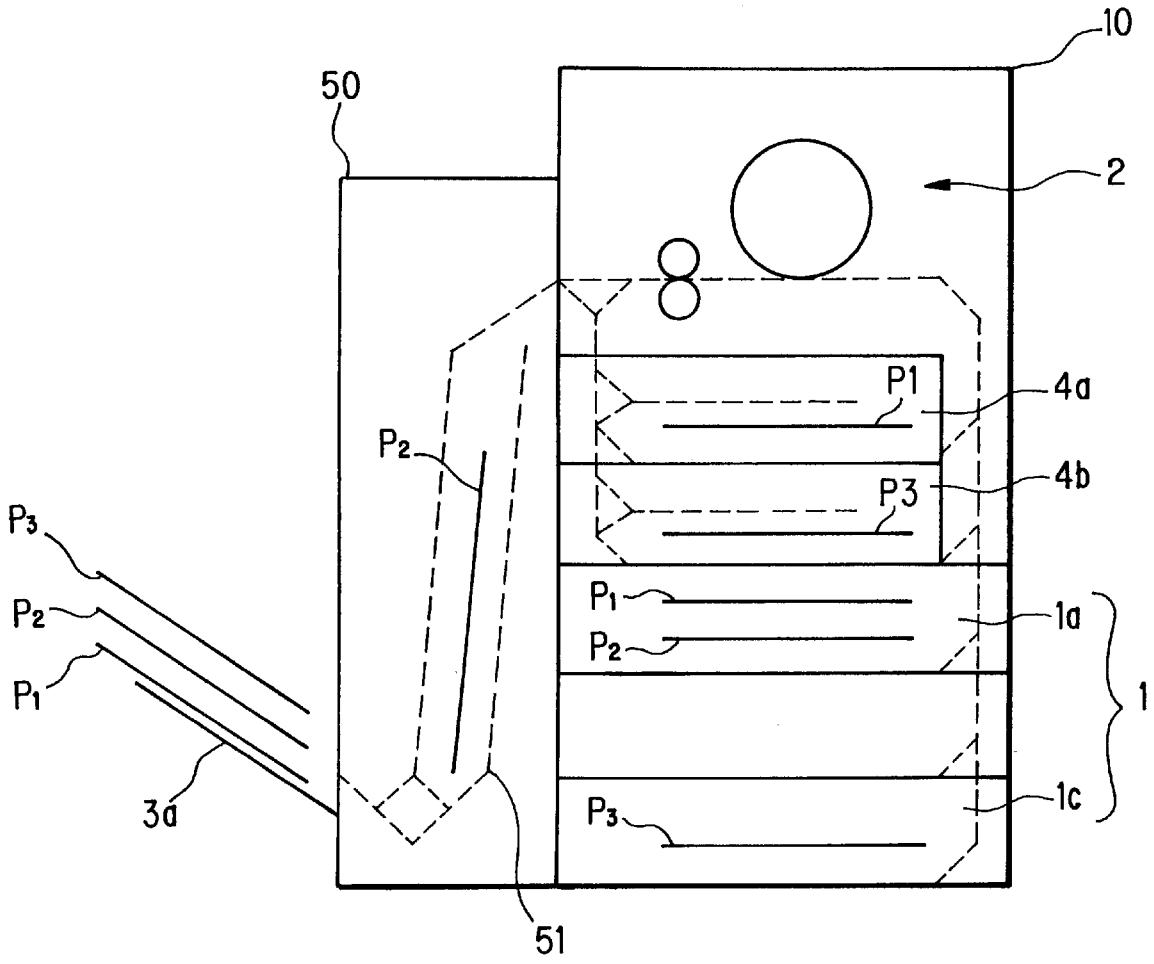
FIG. 11 shows another example of sheets of different sizes conveyed during image formation when image data including both duplex printing image data and one-sided printing image data is input to the image forming apparatus.

FIG. 11 shows another example of sheets of different sizes conveyed during image formation when image data including both image data for duplex printing and image data for one-sided printing is input to the image forming apparatus. In this example, it is assumed that duplex print image data $G_1$ to be formed on the first side of the first paper $P_1$, duplex print image data $G_2$ to be formed on the second side of the first paper $P_1$, one-sided print image data $G_3$ to be formed on the second paper $P_2$, duplex print image data $G_4$ to be formed on the first side of the third paper $P_3$ and duplex print image data $G_5$ to be formed on the second side of the third paper $P_3$ are input in this order. It is also assumed that the first and second papers $P_1$ and $P_2$ are of A4 size while the third paper $P_3$ is of A3 size, and A4-sized paper is stored in the first paper cassette 1*a* and A3-sized paper is stored in the third paper cassette 1*c* in paper feed portion 1 of image forming apparatus 10.

In this case, paper $P_1$ of A4 size is fed first from first paper cassette 1*a* so as to form the image of image data $G_1$ on the first side of paper $P_1$ via imaging portion 2. This paper $P_1$ is then stored into first intermediate tray 4*a*. Next, paper $P_2$ of A4 size is fed from first paper cassette 1*a* so as to form the image of image data $G_3$ via imaging portion 2. This paper $P_2$ is stored into third intermediate tray 51. Thereafter, if paper $P_1$ is imaged with image data $G_2$ and discharged to paper output tray 3*a* first, paper $P_1$ having been imaged on the second side thereof reaches the branchpoint in post-processing apparatus 50 between the paths toward paper output tray 3*a* and toward third intermediate tray 51 before paper $P_2$ has been completely stored in third intermediate tray 51, which may cause paper jam between paper $P_1$ and $P_2$. To avoid this, it is necessary to delay the timing of the start of paper feeding for paper $P_1$ from first intermediate tray 4*a* to imaging portion 2.

For this reason, in this case, after image formation of image data $G_3$ on paper $P_2$, the image of image data $G_4$ is formed on the first side of paper $P_3$ fed from paper cassette 1*c* in advance and stored into second intermediate tray 4*b*. Thereafter paper $P_1$ fed from first intermediate tray 4*a* is formed on its second side with the image of the image data $G_2$ and is discharged to paper output tray 3*a*. Next, paper $P_2$ stored in third intermediate tray 51 is discharged to paper output tray 3*a*. Then, paper $P_3$ fed from second intermediate tray 4*b* is formed on its second side with the image of image data $G_5$ and is discharged to paper output tray 3*a*.

By this sequence, use of third intermediate tray 51 arranged between imaging portion 2 and paper output tray 3*a* and use of first intermediate tray 4*a* and second intermediate tray 4*b* incorporated within image forming apparatus 10 enable proper discharge of a plurality of papers without jamming, by taking into account the conveyance time of each sheet when data including both image data for duplex printing and image data for one-sided printing is input.

In accordance with the first aspect of the invention, based on the determination result as to whether each recording medium is one of which images are to be formed on both sides or one of which an image is to be formed on one side, the conveyance path of the recording medium is selected. Therefore, even in an image forming task which involves both recording media of which images are to be formed on both sides and recording media of which images are to be formed on one side, it is possible to correctly convey the recording media of which images are formed on both sides and the recording media of which images are formed on one side, in conformity with the image forming process to be performed upon them. As a result, it is possible to cut out time loss during the image forming task and hence improve the operational efficiency.

In accordance with the second aspect of the invention, based on the determination result as to whether each recording medium is one of which images are to be formed on both sides or one of which an image is to be formed on one side, the medium is selectively directed to the first conveyance path extending from the imaging portion to the paper output portion by way of the storage portion and imaging portion or the second conveyance path extending from the imaging portion to the paper output portion. Therefore, even in an image forming task which involves both recording media of which images are formed on both sides and recording media of which images are formed on one side, a recording medium, of which an image is formed on one side only, is avoided from being conveyed by way of the storage portion and imaging portion to the paper output portion after the image is formed on one side thereof. Thus, it is possible to cut out time loss during conveyance of recording media of which images are formed on one side and hence improve the operational efficiency.

In accordance with the third aspect of the invention, based on the determination result as to whether the recording media to be imaged are ones for duplex printing or ones for one-sided printing and based on the conditions of conveyance including conveyance time of the recording media, the order of conveyance of the recording media passing through a plurality of conveyance paths is determined. Therefore, in an image forming task which involves both recording media of which images are formed on both sides and recording media of which images are formed on one side, the order in which one recording medium to be imaged on both sides and another recording medium to be imaged on both sides are conveyed is determined, at least, by taking into account the time required for them to be conveyed. As a result, it is possible to execute the image forming task in the shortest period and hence improve the operational efficiency.

In accordance with the fourth aspect of the invention, based on the determination result as to whether the recording media to be imaged are ones for duplex printing or ones for one-sided printing and based on the conditions of conveyance including conveyance time of the recording media, it is determined which is started first, the conveyance of a recording medium from the paper feed portion to the imaging portion or the conveyance of another, different recording medium from the storage portion to the imaging portion. Therefore, in an image forming task which involves both recording media of which images are formed on both sides and recording media of which images are formed on one side, the order of the conveyance of one recording medium to be imaged on one side only from the paper feed portion and the conveyance of another, different recording medium to be image on both sides from the storage portion is determined, at least, by taking into account the time required for them to be conveyed. As a result, it is possible to execute the image forming task in the shortest period and hence improve the operational efficiency.

In accordance with the fifth or sixth aspect of the invention, based on the determination result as to whether the recording media to be imaged are ones for duplex printing or ones for one-sided printing and based on the conditions of conveyance including conveyance time of the recording media, it is determined which is started first, either the conveyance of a recording medium from the imaging portion to the paper output portion or the conveyance of another, different recording medium from the storage portion to the paper output portion. Therefore, in an image forming task which involves both recording media of which images are formed on both sides and recording media of which images are formed on one side thereof, it is possible to determine which is discharged first from the imaging portion or the storage portion, the recording medium for duplex printing or the recording medium for one-sided printing, at least, by taking into account the time required for them to be conveyed. Therefore, it is possible to execute the image forming task in the shortest period and hence improve the operational efficiency.

In accordance with the seventh or eighth aspect of the invention, a plural number of storage portions are arranged in the conveyance path of recording media. Therefore, in an image forming task in which recording media to be imaged on both sides and recording media to be imaged on one side only are mixed arbitrarily, a plural number of recording media of which images are formed on one side or both sides can be stored as appropriate into any of the plural number of storage portions, thus obtaining a desired state of image formation.

In accordance with the ninth aspect of the invention, at least one storage portion is provided within the conveyance path connecting the downstream side of the imaging portion to the upstream side thereof while at least another storage portion is provided between the imaging portion and the paper output portion. That is, an extra storage portion is arranged between the imaging portion and the paper output portion, other than the storage portion for storing a recording medium which is to be imaged on both sides and has been already imaged on one side, so that the storage portion located between the image portion and the paper output portion can stores a recording medium having an image formed on one side or images on both sides before its discharge. Therefore, in an image forming task in which recording media to be imaged on both sides and recording media to be imaged on one side only are mixed arbitrarily, the recording media for duplex printing and one-sided printing can be discharged to the paper output portion in the desired order, thus facilitating the handling of a plurality of papers after image formation.

What is claimed is:

1. An image forming apparatus comprising:

a determining means for determining whether the image data to be imaged is one for a recording medium of which images are formed on both sides or one for a recording medium of which an image is formed on only one side; and a conveyance path switching means for switching the conveyance path of the recording medium based on a determination result.

2. The image forming apparatus according to claim 1, wherein the conveyance path switching means switches the conveyance path between a first conveyance path for conveying a recording medium, on which an image has been formed on one side via a imaging portion, to a paper output portion by way of a storage portion and the imaging portion and a second conveyance path for directly conveying a recording medium, on which an image has been formed on one side via the imaging portion, to the paper output portion.

3. The image forming apparatus according to claim 1 or 2, wherein the conveyance path switching means further comprises a conveyance order determining means for determining the order of conveyance of the recording media passing through a plurality of conveyance paths, based on the determination result from the determining means and based on the conditions including the conveyance time of the recording media.

4. The image forming apparatus according to claim 3, wherein the conveyance order determining means includes means for determining the order in which recording media are conveyed from a paper feed portion or the storage portion to the imaging portion.

5. The image forming apparatus according to claim 3, wherein the conveyance order determining means determines the order in which recording media are discharged to the paper output portion.

6. The image forming apparatus according to claim 4, wherein the conveyance order determining means determines the order in which recording media are discharged to the paper output portion.

7. The image forming apparatus according to claim 2, 4, 5 or 6, wherein a plural number of storage portions are provided at appropriate positions along the conveyance path.

8. The image forming apparatus according to claim 3, wherein a plural number of storage portions are provided at appropriate positions along the conveyance path.

9. The image forming apparatus according to claim 7, wherein at least one of the storage portions is provided within the conveyance path connecting the downstream side of the imaging portion to the upstream side thereof while at least another, different storage portion is provided between the imaging portion and the paper output portion.

10. The image forming apparatus according to claim 8, wherein at least one of the storage portions is provided within the conveyance path connecting the downstream side of the imaging portion to the upstream side thereof while at least another, different storage portion is provided between the imaging portion and the paper output portion.

* * * * *